US012723588B2

(12) United States Patent
Wei et al.

(10) Patent No.: US 12,723,588 B2
(45) Date of Patent: Sep. 1, 2026

(54) VACUUM PUMP ASSEMBLY WITH IMPROVED PROCESS BY-PRODUCT HOLDING CAPACITY

(71) Applicant: BEIJING GRAND HITEK. CO., LTD., Beijing (CN)

(72) Inventors: Min Wei, Beijing (CN); Xiaohong Lei, Beijing (CN); Xiaobo Lei, Beijing (CN); Chong Peng, Beijing (CN)

(73) Assignee: BEIJING GRAND HITEK. CO., LTD., Beijing (CN)

( * ) Notice: Subject to any disclaimer, the term of this patent is extended or adjusted under 35 U.S.C. 154(b) by 0 days.

(21) Appl. No.: 19/336,515

(22) Filed: Sep. 23, 2025

(65) Prior Publication Data

US 2026/0016012 A1 Jan. 15, 2026

Related U.S. Application Data

(63) Continuation of application No. PCT/CN2024/083154, filed on Mar. 22, 2024.

(30) Foreign Application Priority Data

Mar. 23, 2023 (CN) ..... 202310292694.X

(51) Int. Cl.
*F04C 25/02* (2006.01)
*F04C 18/08* (2006.01)
*F04C 18/12* (2006.01)

(52) U.S. Cl.
CPC ..... *F04C 25/02* (2013.01); *F04C 18/084* (2013.01); *F04C 18/126* (2013.01); (Continued)

(58) Field of Classification Search
CPC ..... F04C 2/126; F04C 18/126; F04C 25/02; F04C 2220/10; F04C 2280/02
See application file for complete search history.

(56) References Cited

U.S. PATENT DOCUMENTS

2005/0069440 A1* 3/2005 Naito ..... F04C 25/02 418/9
2010/0104464 A1 4/2010 Schofield
2021/0108639 A1* 4/2021 Rong ..... F04C 29/0092

FOREIGN PATENT DOCUMENTS

CN 101238294 A 8/2008
CN 101668950 A 3/2010
(Continued)

OTHER PUBLICATIONS

International Search Report of PCT Patent Application No. PCT/CN2024/083154 issued on Apr. 21, 2024.

*Primary Examiner* — Laert Dounis

(57) ABSTRACT

Disclosed is a vacuum pump assembly with an improved process by-product holding capacity, including a front bearing plate (1), an upper casing (2), a lower casing (3), a long rotor (4), a short rotor (5), and a rear bearing plate (6); the long rotor (4) and the short rotor (5) rotate about their respective rotary shafts in opposing directions, axes of the rotary shafts of the long rotor (4) and the short rotor (5) being set parallel to each other; the multiple stages of rotor elements of the long rotor (4) and the multiple stages of rotor elements of the short rotor (5) mesh with one another correspondingly; storage grooves (43, 54) are set on non-critical surfaces of rotor elements when meshing with one another. The disclosure improves process by-product holding capacity and effectively prevents pump jamming and wear caused by adhesion of the process by-product.

9 Claims, 5 Drawing Sheets

(52) U.S. Cl.
CPC ..... *F04C 2220/12* (2013.01); *F04C 2240/20* (2013.01); *F04C 2240/30* (2013.01); *F04C 2240/50* (2013.01)

(56) References Cited

FOREIGN PATENT DOCUMENTS

| | | | | | |
|---|---|---|---|---|---|
| CN | 110741165 | A | | 1/2020 | |
| CN | 210715095 | U | | 6/2020 | |
| CN | 114593051 | A | | 6/2022 | |
| CN | 116123091 | A | * | 5/2023 | ..... F04C 23/001 |
| JP | 2010131321 | A | | 6/2010 | |
| KR | 20200041181 | A | | 4/2020 | |
| WO | 2007015056 | A1 | | 2/2007 | |

* cited by examiner

VACUUM PUMP ASSEMBLY WITH IMPROVED PROCESS BY-PRODUCT HOLDING CAPACITY

CROSS REFERENCE TO RELATED APPLICATIONS

The present application is a Continuation Application of PCT Application No. PCT/CN2024/083154 filed on Mar. 22, 2024, which claims priority to Chinese Application No. 202310292694.X entitled "Vacuum Pump Assembly with Improved Process By-product Holding Capacity and Dry Vacuum Pump" filed on Mar. 23, 2023 with China National Intellectual Property Administration, the content of which is incorporated herein by reference in its entirety.

FIELD

The present disclosure relates to a vacuum pump, and more particularly relates to a vacuum pump assembly with an improved process by-product holding capacity.

BACKGROUND

A vacuum pump is engineered to remove gas molecules from a vacuum chamber so as to reduce gas pressure in the vacuum chamber till a desired vacuum degree. The vacuum pump is mainly applied to various sectors including pharmaceuticals and chemicals, vacuum coating, vacuum drying, surface processing, vacuum melting, ceramic manufacturing, food packaging, milking industry, and beverage.

A vacuum pump has two rotors the axes of which are parallel to each other. Each rotor comprises disks and a shaft, with clearances existent between the disks, between the disks and the casing, and between the disks and the wall plate to prevent mutual contacts. The two rotors are actuated by an electric motor via a pair of synchro gears to rotate at equal velocities in opposing directions. By virtue of mutual meshing between two disks, the intake port and the exhaust port of the pump do not communicate directly; the disks, the casing, and the wall plate enclose a sealed elementary volume; with continuous rotation of the disks, the elementary volume is constantly in a gas suction-compression-delivery-exhaust circular state to continuously discharge the air and powders in the chamber out of the pump to fulfill engineering requirements.

Various types of dry vacuum pumps have been available in the market, which utilize different processes and require different pump types. For example, the Chinese Patent Application No. CN110741165A discloses a twin shaft vacuum pump, comprising: two cooperating rotors configured to rotate in opposite directions about parallel axes of rotation; a stator comprising a stator bore in which the rotors are mounted to rotate. The stator bore comprises a central portion between the two axes of rotation, and an outer portion outside the two axes, the rotors being dimensioned to cooperate with the stator bore such that an outer edge of each rotor that is distant from the other rotor is sealed with the stator bore when rotating in at least a portion of the outer portion. A fluid inlet is provided in the stator bore, at least a portion of the fluid inlet being in the central portion of the stator bore between the axes of rotation. A fluid outlet is provided on an opposing surface of the stator bore, the fluid outlet being in the central portion of the stator bore. The fluid inlet and the fluid outlet are arranged such that on rotation of the rotors, the rotors each move a pumping chamber between the fluid inlet and the fluid outlet; where at least a portion of the fluid inlet is arranged to extend beyond the central portion of the stator bore. However, in an application environment with a large volume of process by-products, the conventional vacuum pump apparently has an insufficient capacity in holding the process by-products; during operation, powders of the process by-products would be discharged out of the pump along with the exhaust gas; however, when the pump stops, the powders of the process by-products would be adhered on the surfaces of the rotors and the casing; since the interstices between the rotors and between the rotors and the casing are very narrow (only 0.02 mm in the narrowest portion), the adhered process by-products would occupy the interstices between the rotors and between the rotors and the casing, causing wear to the dry vacuum pump, and in worse situations, causing jamming of the dry vacuum pump, which degrades the service life of the vacuum pump and significantly increases the operation and maintenance costs of the pump.

Therefore, it is desirable in the art to improve a process by-product holding capacity of a vacuum pump to prevent pump jamming and wear caused by process by-product powder adhesion, so as to overcome the drawbacks in conventional solutions.

SUMMARY

To overcome the drawbacks in conventional technologies, the present disclosure provides a vacuum pump assembly with an improved process by-product holding capacity. The present disclosure specifically adopts a technical solution set forth infra.

A vacuum pump assembly with an improved process by-product holding capacity, comprising: a front bearing plate, an upper casing, a lower casing, a long rotor, a short rotor, and a rear bearing plate; wherein

- the long rotor and the short rotor rotate about their respective rotary shafts in opposing directions, axes of the rotary shafts of the long rotor and the short rotor being set parallel to each other;
- the long rotor and the short rotor each comprise multiple stages of rotor elements, the multiple stages of rotor elements being arrayed at intervals in respective axial directions of the rotary shafts of the long rotor and the short rotor;
- the multiple stages of rotor elements of the long rotor and the multiple stages of rotor elements of the short rotor mesh with one another correspondingly, storage grooves being set on non-critical surfaces of the rotor elements when meshing with one another;
- and the non-critical surfaces of the rotor elements are portions of each of the multiple stages of rotor elements which do not create sealing with inner sidewalls of the upper casing and the lower casing and portions other than blade peaks and blade valleys of the rotor elements.

Furthermore, a section of each of the multiple stages of rotor elements in the long rotor and the short rotor perpendicular to their respective rotary shafts has a Y-shaped three-blade structure; when the long rotor and the short rotor rotate, sealing is created between an apex of one blade of one three-blade structure in each stage of rotor element distant from another three-blade structure in the same rotor element and the inner sidewalls of the upper casing and the lower casing.

Furthermore, a plurality of storage grooves are arranged on the long rotor, one end of each of the storage groves communicating with an end surface of the long rotor facing a gas intake direction, another end thereof not communicating with an end surface of the long rotor facing a gas exhaust direction.

Furthermore, a plurality of storage grooves are arranged on the short rotor, one end of each of the storage grooves not communicating with an end surface of the short rotor facing the gas intake direction, another end thereof communicating with an end surface of the short rotor facing the gas exhaust direction.

Furthermore, when the multiple stages of rotor elements of the long rotor mesh with the multiple stages of rotor elements of the short rotor, the storage grooves arranged on the long rotor are staggered with the storage grooves arranged on the short rotor.

Furthermore, lengths of respective rotor elements of the long rotor and the short rotor are shrunk stage by stage along the axes of their respective rotary shafts in a direction from gas intake towards gas exhaust.

Furthermore, the upper casing and the lower casing each comprise multiple stages of working chambers corresponding to the multiple stages of rotor elements, the multiple stages of working chambers being arrayed at intervals in respective axial directions of the rotary shafts.

Furthermore, upper-side-surface storage grooves are arranged on two ends of the upper casing facing the front bearing plate and the rear bearing plate, respectively.

Furthermore, lower-side-surface storage grooves are arranged on two ends of the lower casing facing the front bearing plate and the rear bearing plate, respectively.

Furthermore, a plurality of lower-interstage-plate storage grooves are arranged on the upper surface of the lower casing, the lower-interstage-plate storage grooves being provided on upper surfaces of the interstage plates between the multiple stages of working chambers; and/or a plurality of upper-interstage-plate storage plates are arranged on a lower surface of the upper casing, the upper-interstage-plate storage grooves being provided on lower surfaces of the interstage plates between the multiple stages of working chambers.

By increasing the storage grooves on non-critical portions of the rotors and the casings, the present disclosure improves the process by-product holding capacity and effectively prevents pump jamming and wear caused by adhesion of the process by-products.

DETAILED DESCRIPTION OF EMBODIMENTS

Figure 1:
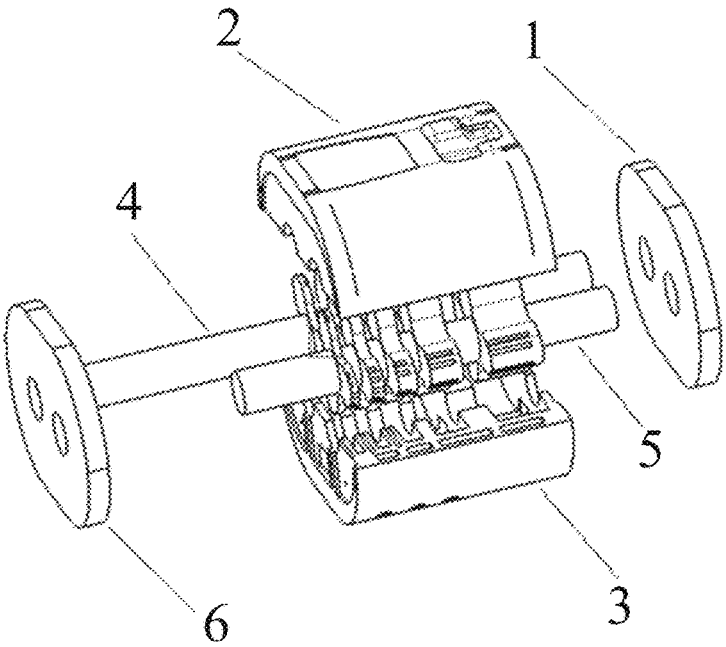
FIG. 1 is a structural schematic diagram of a vacuum pump assembly with an improved process by-product holding capacity according to some implementations of the present disclosure.

Hereinafter, the present disclosure will be further described with reference to the accompanying drawings. The example implementations described herein are only intended for illustrating the technical solutions of the present disclosure more clearly, not intended for limiting the scope of protection of the present disclosure. It is noted that, the detailed description is only exemplary, intended for further explaining the present disclosure.

Unless otherwise indicated, all technological and scientific terms referred to herein have same meanings as generally understood by a person of normal skill in the art. It is noted that, the terms referred to therein are only intended for describing specific implementations, not intended for limiting the example implementations of the present disclosure. unless otherwise explicitly indicated, a single form of a term referred to herein is also intended for covering its plural form. In addition, the terms "comprise" and/or "include" referred to herein indicate presence of features, steps, operations, devices, components and/or combinations thereof.

The present disclosure provides some structures to improve a chamber process by-product holding capacity, which are intended to overcome the issues of conventional dry vacuum pumps that have an insufficient process by-product holding capacity; otherwise, powders such as process by-products would be built up in the chamber and adhered on the surfaces of the rotors and the casings causing jamming of the dry vacuum pump, significantly decreasing its service life and increased operation and maintenance.

To improve the chamber process by-product holding capacity, it is needed to increase holding capacity of the working chamber. The present disclosure mainly improves the process by-product holding capacity from the following two aspects:

a) from the Aspect of Rotors

Given that the thickness, maximum outer contour diameter, and profile of each stage of rotor element are fixed, the design can only be optimized on the meshing surfaces of the rotor elements. Considering that the designed structure cannot affect pumping efficiency, design of the storage groove shall focus on the following points:

1) the storage grooves cannot overlap when the rotor elements mesh with each other;
2) the storage grooves cannot pass through the rotor elements; otherwise, communication between two sides of the rotor elements would cause backflow of the pumped gas, seriously affecting gas pumping efficiency.

b) from the Aspect of Casing

Given that the groove width and radius of each stage of the casing are fixed, the design can only be optimized on the interstage plates and two sides of the casing. Considering that the structure design cannot affect gas pumping efficiency, design of the storage groove shall focus on the following points:

1) when designing a storage groove on an interstage plate, it needs to ensure that two sides of the interstage plate do not communicate;
2) the storage groove cannot affect gas pumping efficiency;

3) the external dimension needs to be considered, and meanwhile the storage grooves on two sides of the casing shall not affect the strength of the interstage plate of the casing.

Based on the design concepts noted supra, the present disclosure provides the following structural designs to improve the chamber process by-product holding capacity:

a) Add Storage Grooves on the Multiple Stages of Rotor Elements.

Storage grooves are additionally provided on non-critical surfaces of mutually meshing rotor elements. The storage grooves are formed axially on each stage of rotor element, but cannot pass through the rotor element. In addition, the storage grooves on the long rotor are staggered with those on the short rotor, with their grooving directions being opposite. The storage grooves on the long rotor and the storage grooves on the short rotor cannot mesh with each other; otherwise, gas backflow would occur, affecting gas pumping efficiency.

b) Add Storage Grooves on the Casing.

The storage grooves on the casing are differentiated into two groups:

1) storage grooves on each stage of interstage plate;

2) storage grooves on two sides of the casing.

As illustrated in FIG. 1, an implementation of the present disclosure provides a vacuum pump assembly with an improved process by-product holding capacity. The vacuum pump assembly with improved process by-product holding capacity comprises: a front bearing plate 1, an upper casing 2, a lower casing 3, a long rotor 4, a short rotor 5, and a rear bearing plate 6; in this implementation, the front bearing plate 1, the rear bearing plate 6, the upper casing 2, and the lower casing 3 enclose to form an accommodation cavity, the long rotor 4 and the short rotor 5 being accommodated in the accommodation cavity, the long rotor 4 and the short rotor 5 having a shaft bore running through their thickness, respectively, a rotary shaft passing through a corresponding shaft bore, two ends of the rotary shaft extending out of the shaft bores on the front bearing plate 1 and the rear bearing plate 6, respectively.

On mounting, the lower casing 3 is first placed at a designated position of the vacuum pump, then the long rotor 4 and the short rotor 5 are mounted in sequence, then the upper casing 2 is snap-fitted, and finally the front bearing plate 1 and the rear bearing plate 6 are secured to two sides of the upper casing 2.

On operation, the long rotor 4 and the short rotor 5 rotate in opposing directions about their respective rotary shafts, for example, the long rotor 4 rotates clockwise, and correspondingly the short rotor 5 rotates counterclockwise; or, the long rotor 4 rotates counterclockwise, and correspondingly the short rotor 5 rotates clockwise. Moreover, the axes of the rotary shafts of the long rotor 4 and the short rotor 5 are set parallel to each other; it is noted that the parallel setting here shall be interpreted broadly; considering the manufacturing and installation tolerances, the axes of the rotary shafts of the long rotor 4 and the short rotor 5 are allowed to incline by a certain angle within a range of the tolerances, and such inclinations are also deemed as parallel.

Figure 2:
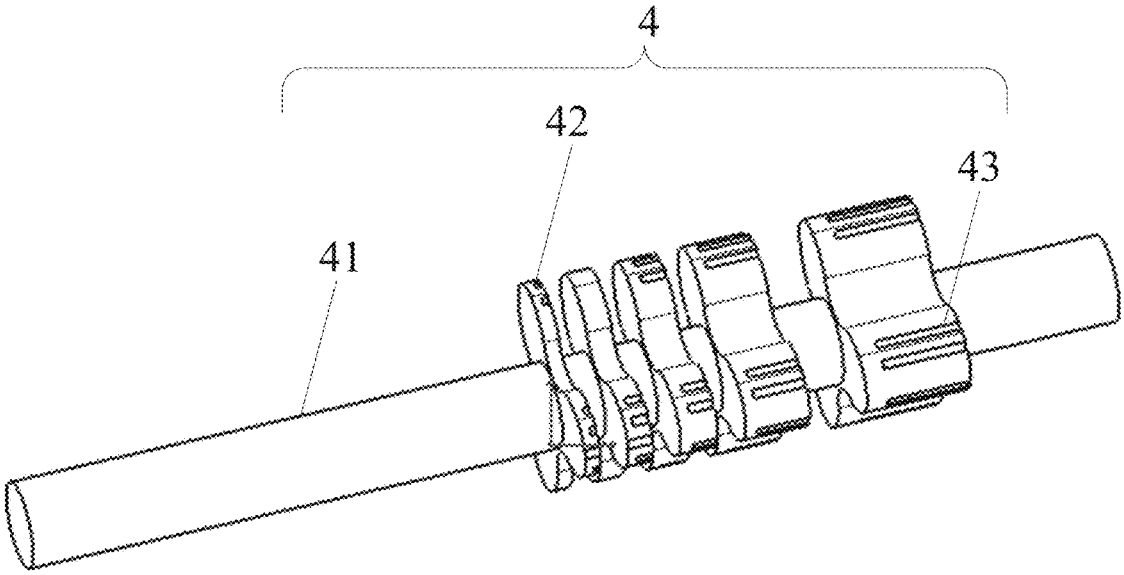
FIG. 2 is a structural schematic diagram of storage grooves on a long rotor in the vacuum pump assembly according to some implementations of the present disclosure.
Figure 3:
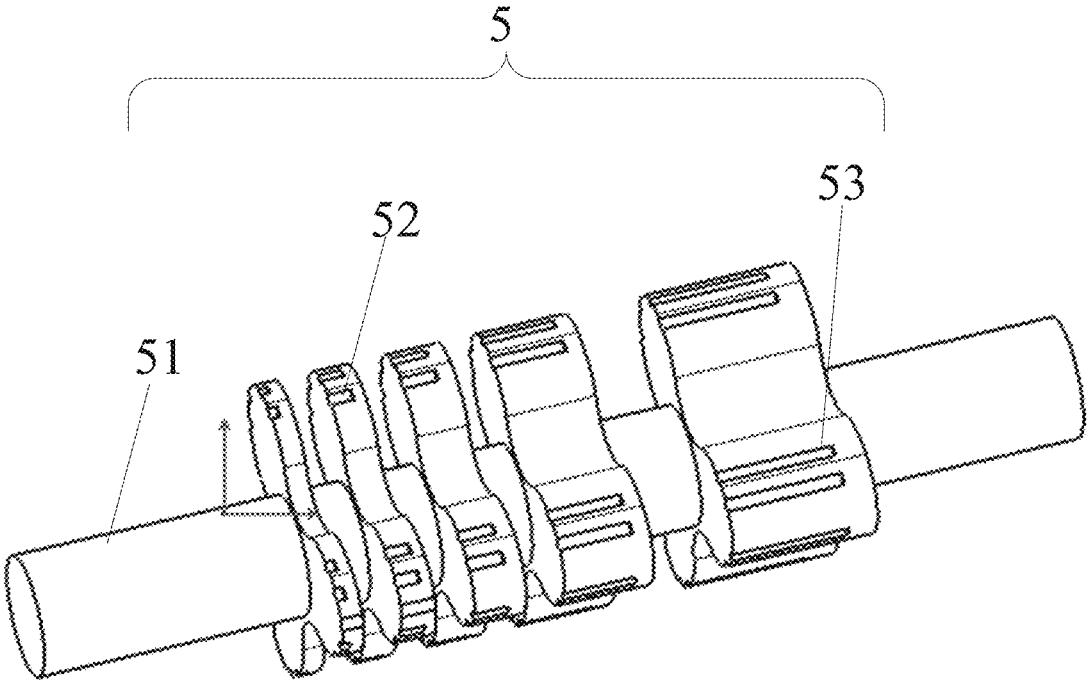
FIG. 3 is a structural schematic diagram of storage grooves on a short rotor in the vacuum pump assembly according to some implementations of the present disclosure.

Referring to FIGS. 2 and 3, the long rotor 4 and the short rotor 5 each comprise multiple stages of rotor elements, the multiple stages of rotor elements being arranged at intervals in an axial direction of their respective rotary shafts.

Specifically, as illustrated in FIG. 2, the long rotor 4 comprises a long rotary shaft 41 and multiple stages of first rotor elements 42 arranged at intervals in the axial direction of the long rotary shaft 41. The multiple stages of first rotor elements 42 may be arranged at even intervals or at uneven intervals; preferably in this implementation, the multiple stages of first rotor elements 42 are arranged at uneven intervals, e.g., the intervals between the multiple stages of first rotor elements 42 are sequentially decreased from the right side to the left side of the long rotary shaft 41 (i.e., in the direction from gas intake to gas exhaust). In addition, lengths of the multiple stages of first rotor elements 42 may be equal or may be unequal; preferably in this implementation, the lengths of the multiple stages of first rotor elements 42 are shrunk stage by stage along the axis of the long rotary shaft 41 in the direction from gas intake towards gas exhaust.

Specifically, as illustrated in FIG. 3, the short rotor 5 comprises a short rotary shaft 51 and multiple stages of second rotor elements 52 arranged at intervals in the axial direction of the short rotary shaft 51. The multiple stages of second rotor elements 52 may be arranged at even intervals or at uneven intervals; preferably in this implementation, the multiple stages of second rotor elements 52 are arranged at uneven intervals, for example, the intervals between the multiple stages of second rotor elements 52 are sequentially decreased from the right side to the left side of the short rotary shaft 51 (i.e., in the direction from gas intake to gas exhaust). In addition, lengths of the multiple stages of second rotor elements 52 may be equal or unequal; preferably in this implementation, the lengths of the multiple stages of second rotor elements 52 are sequentially decreased stage by stage along the axis of the short rotary shaft 51 in the direction from gas intake towards gas exhaust.

Furthermore, as illustrated in FIGS. 2 and 3, the multiple stages of rotor elements of the long rotor 4 and the multiple stages of rotor elements of the short rotor 5 mesh with one another correspondingly, and storage grooves are arranged on non-critical surfaces of mutually meshing rotor elements.

Specifically, as illustrated in FIG. 2, first storage grooves 43 are arranged on the non-critical surfaces of the multiple stages of first rotor elements 42; and as illustrated in FIG. 3, second storage grooves 53 are arranged on the non-critical surfaces of the multiple stages of second rotor elements 52.

In this implementation, the non-critical surfaces of mutually meshing rotor elements are portions of each of the multiple stages of rotor elements which are not sealed with inner sidewalls of the upper casing 2 and the lower casing 4 and portions other than blade peaks and blade valleys of meshing rotor elements. That is to say, the non-critical surfaces do not include the portions of the rotor elements sealed with the inner sidewalls of the upper casing and the lower casing or blade peaks and valleys of meshing rotor elements.

Figure 4:
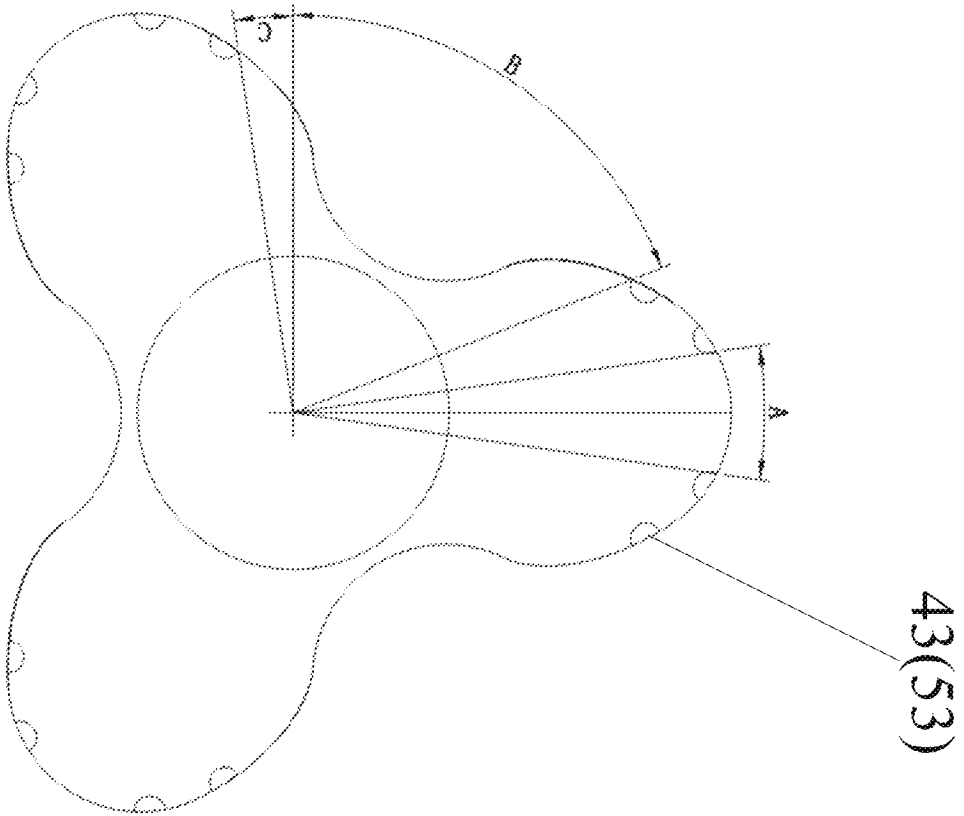
FIG. 4 is a sectional view of a rotor in the vacuum pump assembly according to some implementations of the present disclosure.

As illustrated in FIG. 4, the regions covered by angles A, B, and C are meshing critical surfaces, where no storage grooves shall be made, i.e., the non-critical surfaces do not cover the regions indicated by angles A, B, and C in the figure. As far as the long rotor is concerned, the first storage grooves 43 are provided in regions other than those covered by angles A, B, and C; as far as the short rotor is concerned, the second storage grooves 53 are provided in regions other than those covered by angles A, B, and C. In addition, it is noted that the values of angles A, B, and C may be calculated and rounded based on a series of parameters such as pump center distance, rotating speed, and rotor maximum outer contour as well as empirical formula.

Furthermore, as illustrated in FIG. 4, a section of each of the multiple stages of rotor elements of the long rotor 4 and the short rotor 5 perpendicular to their respective axes of rotation has a Y-shaped three-blade structure, i.e., each stage of rotor element has a Y-shaped three-blade profile; when the long rotor 4 and the short rotor 5 rotate, an apex of one of the three-blade structure of each stage of rotor element distant from another three-blade structure in the same rotor defines a sealed portion with the inner side walls of the upper casing 2 and the lower casing 3.

Furthermore, as illustrated in FIG. 2, a plurality of the first storage grooves 43 are arranged on each stage of first rotor element 42 in the long rotor 4, the first storage grooves 43 being set on the non-critical surfaces of the each stage of first rotor element 42, one end of the first storage groove 43 communicating with an end surface of the each stage of first rotor element 42 facing the gas intake direction, another end of the first storage groove 43 not communicating with the end surface of each stage of first rotor element 42 facing the gas exhaust direction, i.e., the first storage grooves 43 on each stage of first rotor element 42 do not extend through the rotor element to ensure that the two sides of the rotor element do not communicate so as to prevent backflow of the pumped gas.

Moreover, as illustrated in FIG. 3, a plurality of second storage grooves 53 are arranged on each stage of second rotor element 52 in the short rotor 5, the second storage grooves 53 being set on the non-critical surface of each stage of second rotor element 52, one end of the second storage groove 53 communicating with an end surface of each stage of second rotor element 52 facing the gas intake direction, another end of the second storage groove 53 not communicating with the end surface of each stage of second rotor element 52 facing the gas exhaust direction, i.e., the second storage grooves 53 on each stage of second rotor element 52 do not extend through the rotor element to ensure that the two sides of the rotor element do not communicate so as to prevent backflow of the pumped gas.

It is noted that, specific numbers of the storage grooves on the long rotor and the short rotor are not limited herein. For example, as illustrated in FIG. 4, 12 storage grooves are arranged on respective stages of rotor elements of the long rotor and the short rotor, respectively; since the section of each stage of rotor element has a Y-shaped three-blade structure, four storage grooves are set on the non-critical surfaces of each three-blade structure, the four storage grooves being symmetrically arranged.

Furthermore, as illustrated in FIGS. 2 and 3, when the multiple stages of rotor elements of the long rotor 4 and the short rotor 5 mesh with one another, the storage grooves arranged on the long rotor 4 and the storage grooves arranged on the short rotor 5 do not overlap, i.e., in this implementation, the first storage grooves 43 on the long rotor 4 and the second storage grooves 53 on the short rotor 5 are staggered relative to each other, with their grooving directions being opposite, which can prevent gas backflow and further enhance pumping efficiency.

In this implementation, with the storage grooves provided on the rotor elements, the process by-product holding capacity of the pump may reach 15 g.

Figure 5:
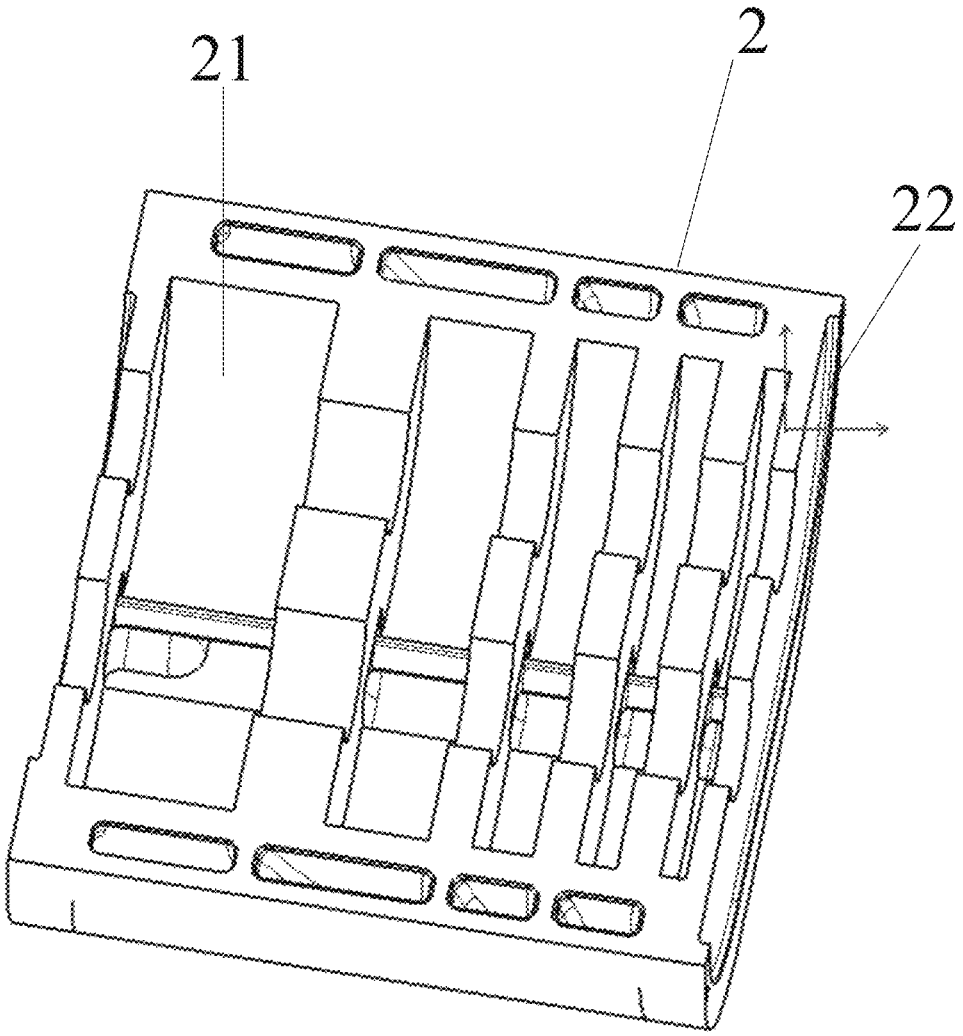
FIG. 5 is a structural schematic diagram of storage grooves on an upper casing in the vacuum pump assembly according to some implementations of the present disclosure.
Figure 6:
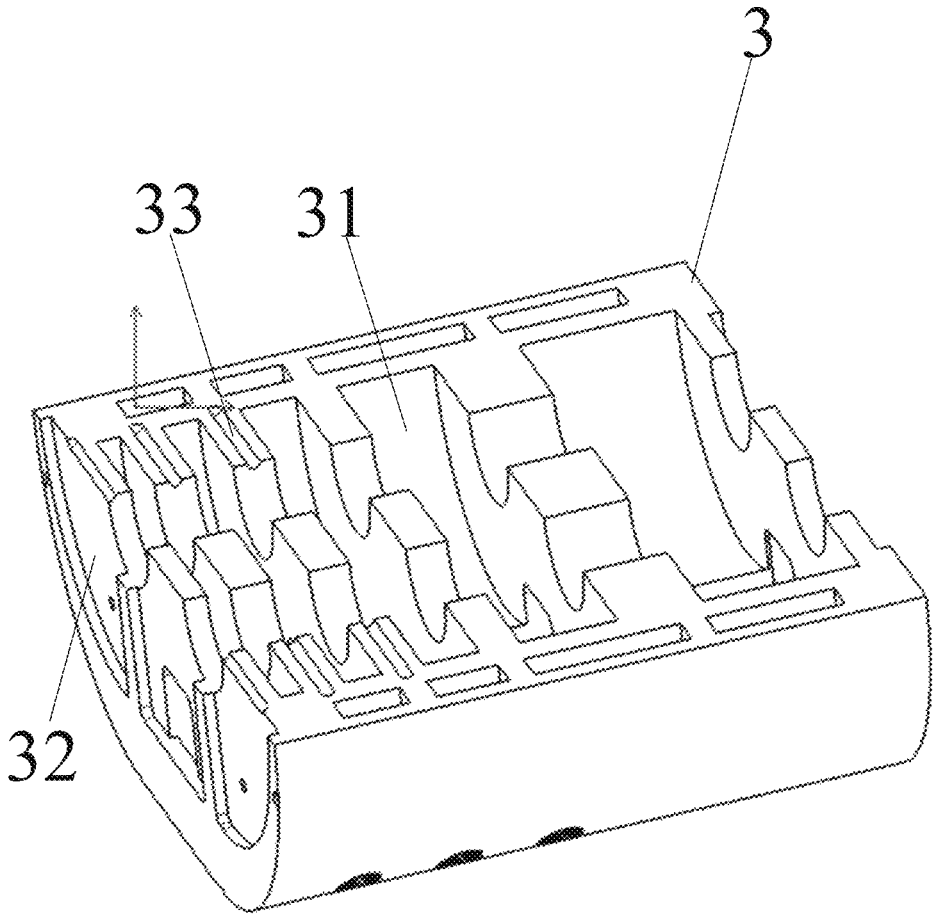
FIG. 6 is a structural schematic diagram of storage grooves on a lower casing in the vacuum pump assembly according to some implementations of the present disclosure.

As illustrated in FIGS. 5 and 6, the upper casing 2 and the lower casing 3 comprise multiple stages of working chambers corresponding to the multiple stages of rotor elements, respectively, the multiple stages of working chambers being arranged at intervals in respective axial directions of the rotary shafts.

As illustrated in FIG. 5, the upper casing 2 is provided with multiple stages of upper working chambers 21 corresponding to the multiple stages of the first rotor elements 42 and the multiple stages of second rotor elements 52, the multiple stages of upper working chambers 21 being arranged at intervals in respective axial directions of the rotary shafts. That is to say, the upper working chambers may serve to accommodate both of the multiple stages of first rotor elements 42 and the multiple stages of second rotor elements 52.

As illustrated in FIG. 6, the lower casing 3 is provided with multiple stages of lower working chambers 31 corresponding to the multiple stages of first rotor elements 42 and multiple stages of second rotor elements 43, the multiple stages of lower working chambers 31 being arranged at intervals in respective axial directions of the rotary shafts. That is to say, the multiple stages of first rotors 42 and the multiple stages of second rotor elements 52 are synchronously accommodated in a cavity enclosed by the lower working chambers and the upper working chambers and rotate in opposing directions about their respective rotary shafts.

Furthermore, as illustrated in FIG. 5, an upper-side-surface storage groove 22 is arranged on two ends of the upper casing 2 facing the front bearing plate 1 and the rear bearing plate 6, respectively, i.e., the upper-side-surface storage grooves 22 are arranged on the two ends of the upper casing 2 in its lengthwise direction, respectively, which further improves the process by-product holding capacity.

Of course, it should be understood that, in addition to the storage grooves arranged at two ends of the upper casing in its lengthwise direction, a plurality of upper-interstage-plate storage grooves may also be arranged on a lower surface of the upper casing; as illustrated in FIG. 5, the plurality of upper-interstage-plate storage grooves are located on the lower surfaces of the interstage plates between the multiple stages of upper working chambers 21; the upper-interstage-plate storage grooves are of a strip shape, cut in a direction perpendicular to the axial direction of the rotary shaft; and one end of each of the plurality of upper-interstage-plate storage grooves extends through an interface between the upper casing 2 and the rotary shaft of the corresponding rotor.

Likewise, as illustrated in FIG. 6, a lower-side-surface storage groove 32 is arranged on two ends of the lower casing 3 facing the front bearing plate 1 and the rear bearing plate 6, respectively, i.e., the lower-side-surface storage grooves 32 are arranged on two ends of the lower casing in its lengthwise direction, respectively. In addition, a plurality of lower-interstage-plate storage grooves 33 are arranged on the upper surface of the lower casing 3, the lower-interstage-plate storage grooves 33 being arranged on the upper surfaces of the interstage plates between the multiple stages of the lower working chambers 31; the lower-interstage-plate storage grooves 33 are of a strip shape, cut in the direction perpendicular to respective axial directions of the rotary shafts; in addition, one end of each of the plurality of lower-interstage-plate storage grooves extends through an interface between the lower casing 3 and respective rotary shafts of the long and short rotors, which further increases the process by-product holding capacity.

It is noted that the upper casing and the lower casing are provided therein with multiple stages of working chambers where the multiple stages of rotor elements are accommodated; the regions located at two sides of the multiple stages of working chambers are referred to as interstage plates, and respective widths of the upper-interstage-plate storage grooves and the lower-interstage-plate storage grooves are 30%~50% of the widths of the corresponding interstage plates.

In this implementation, by additionally providing the side-surface storage grooves and the interstage-plate storage grooves on the upper casing and the lower casing, the process by-product holding capacity increases to about 30 g.

An existing dry vacuum pump without storage grooves has a process by-product holding capacity of less than 1 g; the present disclosure improves the process by-product storage capacity of the dry vacuum pump to about 15 g by setting a set of rotor elements with storage grooves, and further improves the process by-product storage capacity to about 30 g by optimizing the casings, i.e., additionally providing upper- and lower-side-surface storage grooves and interstage-plate storage grooves on the upper and lower casings. As such, the total process by-product holding capacity of the pump may reach 45 g, which significantly extends the service life of the pump and overcomes the technical problems of existing dry pumps such as insufficient process by-product holding capacity causing jamming of the dry vacuum pump and adhesion of the process by-product powders residing in the chamber to the surfaces of the rotors and the casings.

What have been described above are example implementations of the present disclosure. It is noted that, to a person of normal skill in the art, various modifications and transformations may be made without departing from the technical principle of the present disclosure, and all of such modifications and transformations shall be deemed as a scope of protection of the present disclosure.

We claim:

1. A vacuum pump assembly with an improved process by-product holding capacity, comprising: a front bearing plate, an upper casing, a lower casing, a long rotor, a short rotor, and a rear bearing plate; wherein the long rotor and the short rotor rotate about their respective rotary shafts in opposing directions, axes of the rotary shafts of the long rotor and the short rotor being set parallel to each other;

the long rotor and the short rotor each comprise multiple stages of rotor elements, the plurality of rotor elements being arrayed at intervals in respective axial directions of the rotary shafts of the long rotor and the short rotor;

the multiple stages of rotor elements of the long rotor and the multiple stages of rotor elements of the short rotor mesh with one another correspondingly, storage grooves being set on non-critical surfaces of the rotor elements when meshing with one another;

the non-critical surfaces of the rotor elements are portions of each of the multiple stages of rotor elements which do not form a seal with inner sidewalls of the upper casing and the lower casing and portions other than blade peaks and blade valleys of the rotor elements, and wherein a plurality of storage grooves are arranged on the long rotor, one end of each of the storage groves on the long rotor communicating with an end surface of the long rotor facing a gas intake direction, another end thereof not communicating with an end surface of the long rotor facing a gas exhaust direction, or a plurality of storage grooves are arranged on the short rotor, one end of each of the storage grooves on the short rotor not communicating with an end surface of the short rotor facing the gas intake direction, another end thereof communicating with an end surface of the short rotor facing the gas exhaust direction.

2. The vacuum pump assembly with an improved process by-product holding capacity according to claim 1, wherein a section of each of the multiple stages of rotor elements in the long rotor and the short rotor perpendicular to their respective rotary shafts has a Y-shaped three-blade structure; when the long rotor and the short rotor rotate, sealing is created between an apex of one blade of one three-blade structure in each rotor element distant from another three-blade structure in the same rotor element and the inner sidewalls of the upper casing and the lower casing.

3. The vacuum pump assembly with an improved process by-product holding capacity according to claim 1, wherein lengths of respective stages of rotor elements of the long rotor and the short rotor are shrunk stage by stage along the axes of their respective rotary shafts in a direction from gas intake towards gas exhaust.

4. The vacuum pump assembly with an improved process by-product holding capacity according to claim 1, wherein the upper casing and the lower casing each comprise multiple stages of working chambers corresponding to the multiple stages of rotor elements, the multiple stages of working chambers being arrayed at intervals in respective axial directions of the rotary shafts.

5. The vacuum pump assembly with an improved process by-product holding capacity according to claim 4, wherein upper-side-surface storage grooves are arranged on two ends of the upper casing facing the front bearing plate and the rear bearing plate, respectively.

6. The vacuum pump assembly with an improved process by-product holding capacity according to claim 4, wherein lower-side-surface storage grooves are arranged on two ends of the lower casing facing the front bearing plate and the rear bearing plate, respectively.

7. The vacuum pump assembly with an improved process by-product holding capacity according to claim 4, wherein a plurality of lower-interstage-plate storage grooves are arranged on the upper surface of the lower casing, the lower-interstage-plate storage grooves being provided on upper surfaces of the interstage plates between the multiple stages of working chambers; and/or a plurality of upper-interstage-plate storage plates are arranged on a lower surface of the upper casing, the upper-interstage-plate storage grooves being provided on lower surfaces of the interstage plates between the multiple stages of working chambers.

8. The vacuum pump assembly with an improved process by-product holding capacity according to claim 1, wherein the plurality of storage grooves are arranged on the long rotor, one end of each of the storage groves on the long rotor communicating with the end surface of the long rotor facing the gas intake direction, another end thereof not communicating with the end surface of the long rotor facing the gas exhaust direction, and, the plurality of storage grooves are arranged on the short rotor, one end of each of the storage grooves on the short rotor not communicating with the end surface of the short rotor facing the gas intake direction, another end thereof communicating with the end surface of the short rotor facing the gas exhaust direction.

9. The vacuum pump assembly with an improved process by-product holding capacity according to claim 8, wherein when the multiple stages of rotor elements of the long rotor mesh with the multiple stages of rotor elements of the short rotor, the storage grooves arranged on the long rotor are staggered with the storage grooves arranged on the short rotor.

* * * * *